US010294748B2

(12) United States Patent
Barbato et al.

(10) Patent No.: US 10,294,748 B2
(45) Date of Patent: May 21, 2019

(54) INDEXING DART

(71) Applicant: Dreco Energy Services ULC, Edmonton (CA)

(72) Inventors: Vincenzo Barbato, Richmond, TX (US); Richard Westgarth, Cypress, TX (US)

(73) Assignee: Dreco Energy Services ULC, Calgary (CA)

( * ) Notice: Subject to any disclaimer, the term of this patent is extended or adjusted under 35 U.S.C. 154(b) by 0 days.

(21) Appl. No.: 14/734,954

(22) Filed: Jun. 9, 2015

(65) Prior Publication Data

US 2016/0362957 A1 Dec. 15, 2016

(51) Int. Cl.
*E21B 33/12* (2006.01)
*E21B 34/14* (2006.01)

(52) U.S. Cl.
CPC ..... *E21B 33/12* (2013.01); *E21B 34/14* (2013.01)

(58) Field of Classification Search
CPC ..... E21B 33/12; E21B 23/00; E21B 23/004; E21B 23/01; E21B 23/02; E21B 23/03
USPC ..... 166/386
See application file for complete search history.

(56) References Cited

U.S. PATENT DOCUMENTS 6,776,228 B2 * 8/2004 Pedersen ..... E21B 33/05 166/177.4
8,863,853 B1 * 10/2014 Harris ..... E21B 23/004 166/318
2013/0020092 A1 * 1/2013 Ramon ..... E21B 23/01 166/381
2013/0112435 A1 5/2013 Fleming

OTHER PUBLICATIONS

International Search Report, PCT/CA2016/050656, dated Aug. 16, 2016.

* cited by examiner

*Primary Examiner* — Anna M Momper
*Assistant Examiner* — Patrick F Lambe
(74) *Attorney, Agent, or Firm* — Conley Rose, P.C.

(57) ABSTRACT

A wellbore dart or pill is provided such that each time the dart passes through a downhole tool having a seat, an externally extending finger is forced radially inward into the dart. As the finger moves inward to its depressed position, the finger moves a ball or other placeholder from a first position to a second position. When the ball is moved to the second position it may be released into the interior of the well bore or into a chamber in the tool. Once each of the balls have been released from the second position the finger is locked radially outward causing the dart to land and be locked in place at the next seat that is encountered by the dart.

21 Claims, 7 Drawing Sheets

INDEXING DART

BACKGROUND

In the course of producing oil and gas wells, typically after the well is drilled, the well may be completed. One way to complete a well is to divide the well into several zones and then treat each zone individually.

Treating each section of the well individually may be accomplished in several ways. One way is to assemble a tubular assembly on the surface where the tubular assembly has a series of spaced apart sliding sleeves. Sliding sleeves are typically spaced so that at least one sliding sleeve will be adjacent to each zone. In some instances annular packers may also be spaced apart along the tubular assembly in order to divide the wellbore into the desired number of zones. In other instances when annular packers are not used to divide the wellbore into the desired number of zones the tubular assembly may be cemented in place.

The tubular assembly is then run into the wellbore typically with the sliding sleeves in the closed position. Once the tubular assembly is in place in the well and has been cemented in place or the packers have been actuated the wellbore may be treated.

The wellbore treatment typically consists of high pressure pumping of a viscosified fluid containing a proppant down through the tubular assembly out of the specified sliding sleeve and into the formation. The high-pressure fluid tends to form cracks and fissures in the formation letting the viscosified fluid carry the proppant into the cracks and fissures. When the treatment ends, the proppant remains in the cracks and fissures holding the cracks and fissures open and allowing wellbore fluid to flow from the formation zone, through the open sliding sleeve, into the tubular assembly, and then to the surface.

To open a sliding sleeve, an obturator, such as a ball, a dart, etc., is dropped into the wellbore from the surface and pumped through the tubular assembly. The obturator is pumped through the tubular assembly to the sliding sleeve where it lands on the seat of the sliding sleeve and forms a seal with the seat on the sliding sleeve to block all further fluid flow past the ball and the seat. As additional fluid is pumped into the well the differential pressure formed across the seat and ball provides sufficient force to move the sliding sleeve from its closed position to its open position. Fluid may then be pumped out of the tubular assembly and into the formation so that the formation may be treated.

In order to selectively open a particular sliding sleeve the obturator may be sized so that it will pass through the sliding sleeves until finally reaching the sliding sleeve where the seat size matches the size of the obturator. In practice the sliding sleeve with the smallest diameter seat is located closest to the bottom or toe of the well. Each sliding sleeve above the lowest sliding sleeve has a seat with a diameter that is slightly larger than the seat below it. By using seats that step up in size as they get closer to the surface, a small diameter obturator may be dropped into the tubular assembly and will pass through each of the larger diameter seats on each sliding sleeve above the lowest sliding sleeve. The obturator finally reaches the sliding sleeve with a seat diameter that matches the diameter of the obturator. The obturator and seat blocked the fluid flow past the sliding sleeve actuating the particular sliding sleeve.

Progressively larger obturators are launched into the tubular assembly to selectively open each sliding sleeve. Each seat and obturator must be sized so that the seat provides sufficient support for the obturator at the anticipated pressure. Currently there seems to be an upper limit on the number of sliding sleeves that may be actuated by progressively larger obturators and seats thereby limiting the productivity of a single well. An additional limitation of the current technology is that by utilizing progressively smaller seats towards the bottom of the well the productivity of the well is further limited as each seat chokes fluid flow from the bottom of the well towards the top of the well. Therefore in practice there is usually the additional step of drilling out the seats adding further costs to completing the well.

SUMMARY

In order to overcome the limitations of utilizing sequentially sized seats and obturators the current invention provides an actuation dart for actuating the tool in a wellbore.

A wellbore dart or pill is provided such that each time the dart passes through a downhole tool having a seat and externally extending finger is forced radially inward into the dart. In this instance the seat may merely consist of a protrusion to interact with the externally extending finger on the dart. As the finger moves inward to its depressed position, the finger moves a ball or other placeholder from a first position to a second position. When the ball is moved to the second position it may be released into the interior of the wellbore or it may be released into a chamber in the tool. In any event the ball is moved to a second position such that it may not return to the first position when the finger returns from its depressed position to its extended position.

It is envisioned that a number of placeholders or balls will be stacked within the dart waiting to move into the first position adjacent the externally extending finger. The number of balls are placeholders correlate to the number of seats that the dart move through. For instance fifty balls may be placed such that the balls may move into the first position one at a time. As the dart passes each seat the finger is depressed moving the ball in the first position to the second position where it is released. The finger then returns to its extended position allowing the next ball to move into the first position. When all of the, for instance fifty, balls have been released the follower that is moving the balls into the first position will finally move into the first position itself. However the follower is constructed such that when the follower is in the first position the externally extending finger is locked radially outward. When the dart reaches the next seat as the radially extending finger is no longer able to move from its extended position to its depressed position thereby allowing the dart to move past seat the dart locks into the particular seat. The dart may seal on the seat or it may seal on a portion of the tool adjacent to the seat. In either event once the dart is locked into a particular seat fluid pressure may be increased from the surface allowing the dart to actuate the particular tool within which the seat is located.

Each zone in a wellbore may then be accessed by using an indexing dart with its indexing mechanism set to correspond to the particular wellbore tool and seat combination. The number of zones that may be accessed with a single size seat at indexing dart combination is limited only by the number of placeholders that may be carried within the dart.

It is envisioned that most darts will have more than one ball indexing mechanism. It is also envisioned that each dart will be configured to closely fit within the seat in order to allow an increase in fluid pressure when the dart is locked on a particular seat. In many instances the dart may carry a secondary ceiling mechanism in order to increase the dart's ability to seal on a particular seat. Additionally as it is envisioned that the darts will need to be removed from the wellbore the leading edge, the trailing edge, or both of each dart will be equipped with at least one castellation or other anti-rotation device to allow for easy mill out of each dart. In certain instances it in this envisioned that the dart may be constructed of a dissolvable or erodable material.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
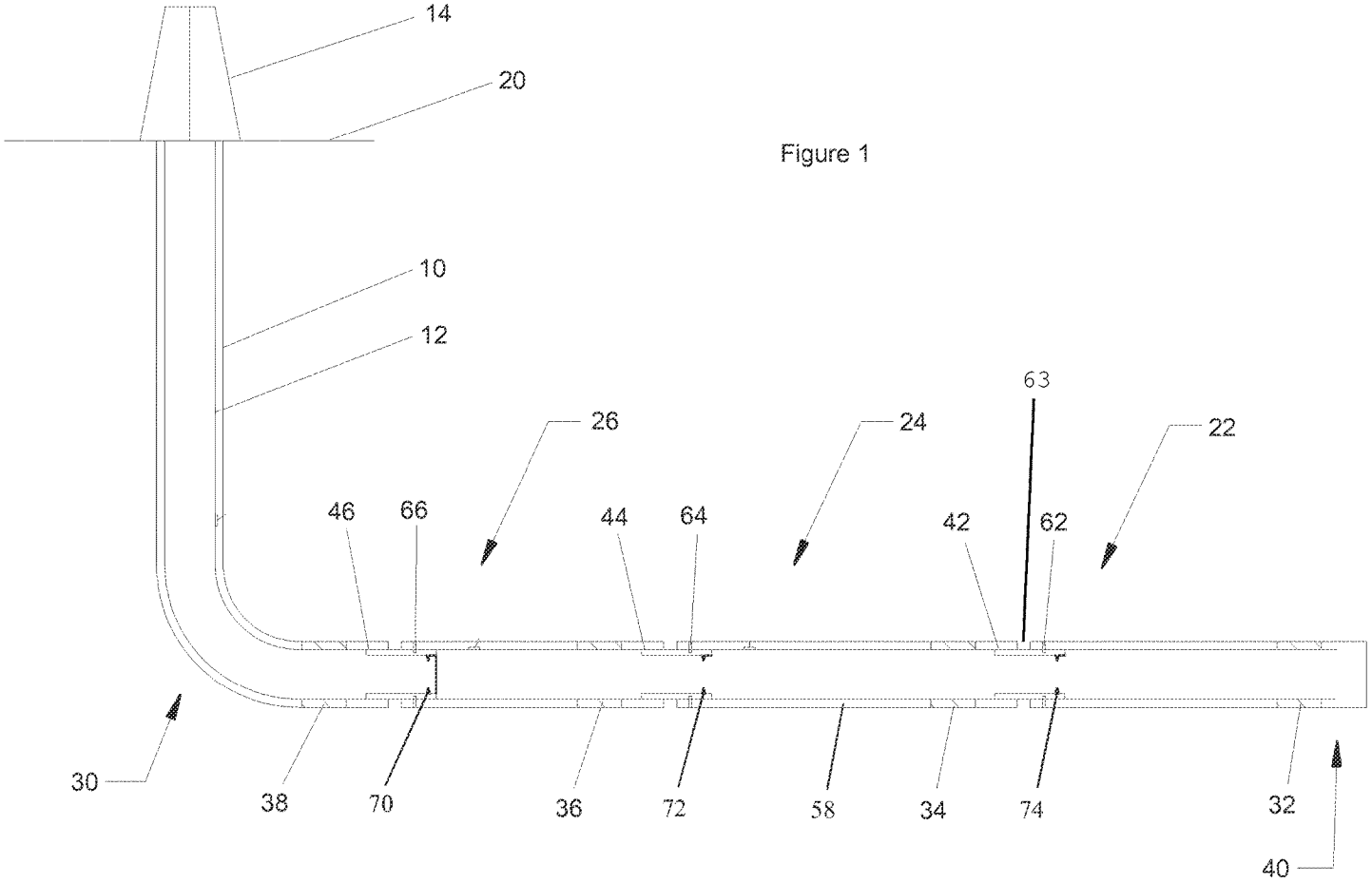
FIG. 1 depicts a tubular assembly with multiple sliding sleeves in a wellbore.

FIG. 1 depicts a completion where a well bore 10 has been drilled through one or more formation zones 22, 24, and 26. A tubular assembly 12, consisting of casing joints, couplings, annular packers 32, 34, 36, and 38, sliding sleeves 42,44, and 46, and seats 70,72, and 74 that are initially pinned in place in the closed position by shear pins 62, 64, and 66, and has been run into the wellbore 10. The well 10, if it is a horizontal or at least nonvertical well, may have a heel 30 and at its lower end will have a toe 40. Typically the casing assembly 12 is made up on the surface 20 and is then lowered into the well bore 10 by the rig 14 until the desired depth is reached so that sliding sleeves 42, 44, and 46 are adjacent formation zones 22, 24, and 26. The annular packers are arranged along the tubular assembly so that annular packer 32 is placed below formation zone 22 and annular packer 34 is placed above formation zone 22 and both annular packers 32 and 34 actuated to isolate formation zone 22 from all of the zones in the well 10. Annular packer 34 is placed so that while it is above formation zone 22 it is below formation zone 24 and annular packer 36 is placed above formation zone 24 and both annular packers 34 and 36 are actuated to isolate formation zone 24 from all other zones in the well 10. Annular packer 36 is placed so that while it is above formation zone 24 it is below formation zone 26 and annular packer 38 is placed above formation zone 26 and both annular packers 36 and 38 are actuated to isolate formation zone 26 from all other zones in the well 10. In certain instances formation isolation will be accomplished by pumping cement out of the toe 40 of tubular assembly 12 and backup the annular region 58 between the wellbore 10 and the tubular assembly 12.

Figure 2:
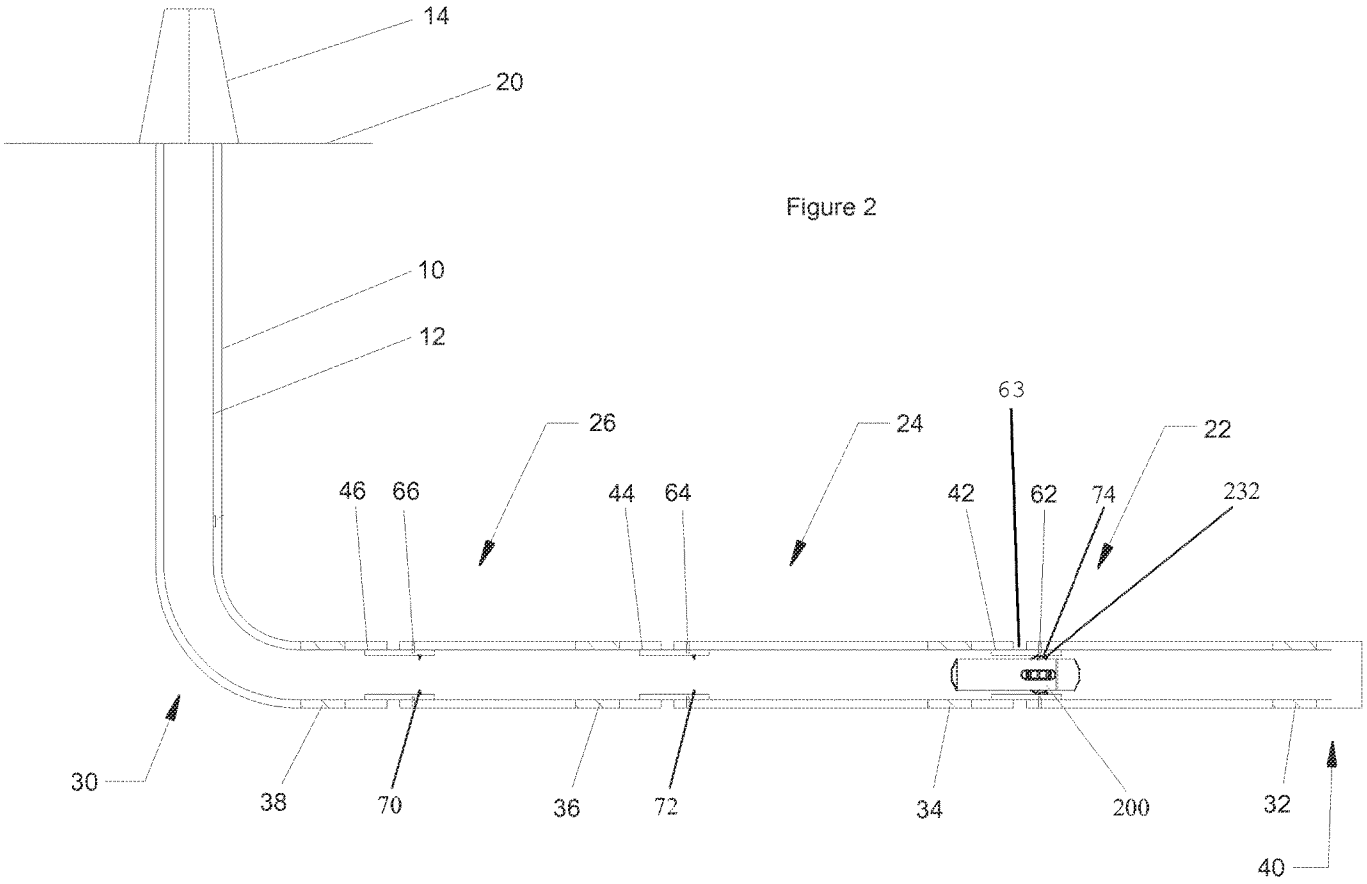
FIG. 2 depicts a tubular assembly having closed sliding sleeves and an indexing dart in a wellbore.

FIG. 2 depicts the well bore 10 and the tubular assembly 12 from FIG. 1 with an indexing dart 200 deployed therein. Indexing dart 200 is initially pumped into the well bore 10 with the desired number of placeholders or balls in the indexing track within the dart 200. The indexing dart 200's collets such as collett 232 is extended radially outward as the indexing dart 200 progresses through the well bore 10. References to specific portions of the indexing dart 200 may be more readily seen in FIGS. 3 and 4. As shown in FIG. 2 the indexing dart 200 would have had 2 placeholders 250 within the indexing track 239 within the dart 200. As the dart 200 passes seat 70 the collet 232 is depressed radially inward allowing one ball or placeholder 250 to be released leaving a single placeholder within the indexing track. Typically the dart 200 releases a placeholder such as a ball 250 by moving the ball 250 from the indexing track 239 into the first position 260. The first position 260 is within port 262 in finger 234. The first position 260 is when the finger 234 is extended radially outward from dart 200. In practice collet 232 exerts a biasing effect upon finger 234 to maintain finger 234 in the radially outward position. The ball 251 is held longitudinally in the first position by a shoulder on the one side and by either the follow-on balls 250 or the follower such as pin 276. The ball 251 is retained in the first position 260 by the circumferential walls of port 262 within finger 234. In the event that dart 200 passes a seat such as seats 70 or 72 the collet 232 and finger 234 are moved radially inward to the second position. With finger 234 moved radially inward, the shoulder no longer retains ball 251 thereby releasing ball 251. As the dart 100 passes seat 72 the collet 232 is again depressed radially inward allowing one ball or placeholder to be released leaving a no placeholders 250 within the indexing track 239 so that the follower 276 in each of the indexing mechanisms within the dart 200 are in the first position preventing the finger 234 and thereby collet 232 from moving radially inward. The follower such as pin 276 is moved such that pin 276 extends radially outward from plate 274 through slot 314 and into port 262 when finger 234 and collet 232 are in the first position. With pin 276 extending through slot 314 and into port 262 finger 234 and collet 232 are prevented from moving from the first position to the second position thereby locking the collet 232 in finger 234 in the radially extended position.

As the dart 200 reaches seat 74 the finger 234 and collet 232 cannot be depressed radially causing dart 200 to become lodged in place with respect to seat 74. As pressure from the surface is increased the ability of shear pin 62 to retain sliding sleeve 42 in position is surpassed there by shifting sliding sleeve 42 from its closed position as shown to an open position allowing fluid access from the interior of the tubing assembly 12 through port 63 into formation zone 22.

Figure 3:
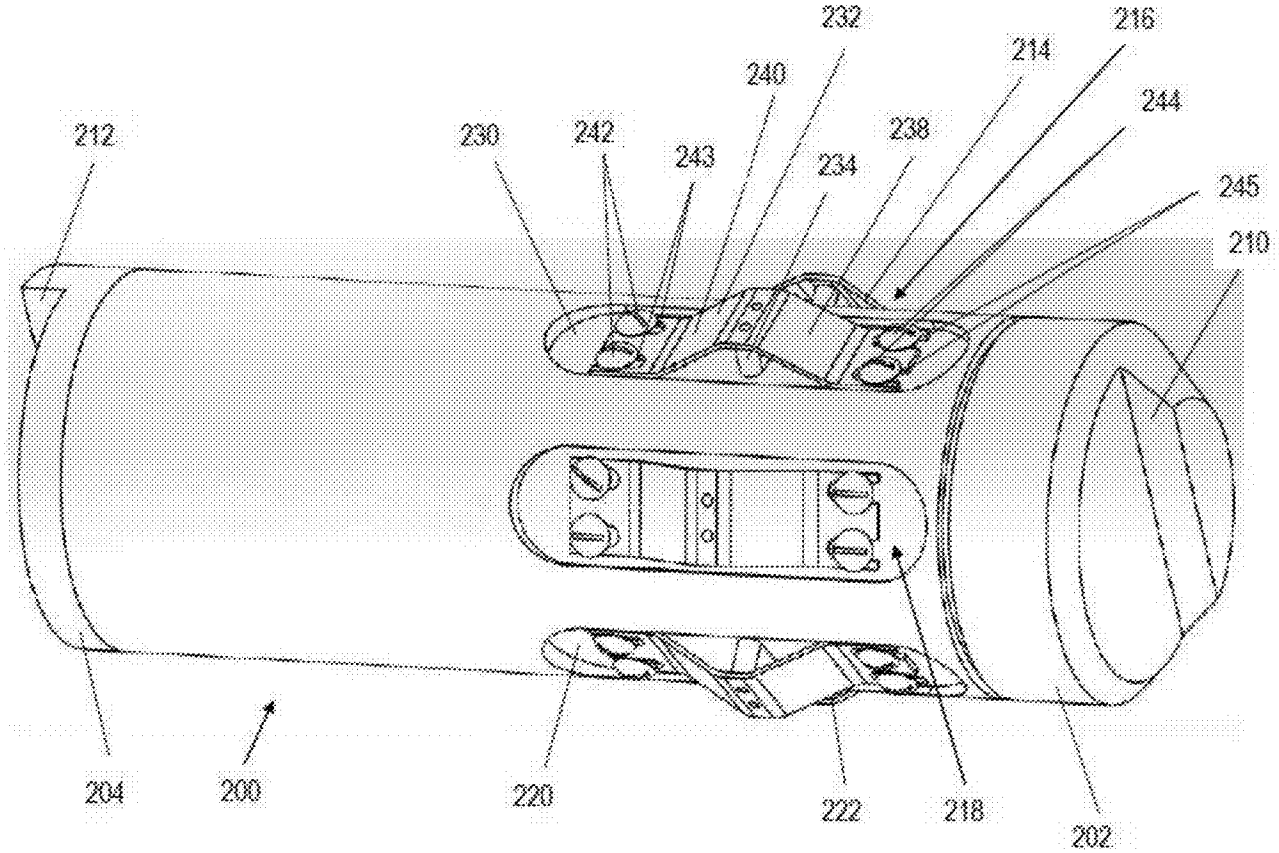
FIG. 3 depicts a dart.

FIG. 3 depicts a dart 200 having a forward end 202 and rearward end 204. The forward end 202 has a castellation 210 to assist in preventing rotation of the dart 200 when the dart 200 is being milled out. The rearward end 204 has a second castellation 212 that also assists in preventing rotation of the dart 200 when the dart 200 is being milled out. In certain instances multiple darts may stack one upon the other so that a forward castellation of one dart may lock into the rearward castellation of a second dart. As shown in FIG. 3 dart 200 has multiple indexing assemblies 214, 216, 218, 220, and 222 around the dart's 200 circumference. For ease of discussion only indexing assembly 216 will be referred to from here on out with regard to FIG. 3. A recess 230 is formed on the exterior of the dart 200. A collet 232 is placed over finger 234. The sloped forward portion 238 of collet 232 allows finger 234 to interact with a seat such as seat 72 in FIG. 2 without hanging or catching on seat 72. The collet 232 also has a sloped rearward portion 240 that will allow finger 234 to interact with a seat such as seat 72 in FIG. 2 without hanging or catching on seat 72 in the event that dart 200 were run into the tubular assembly 12 in reverse. Collet 232 is fastened to dart 200 by screws 242 and 244. Collet 232 has slots 243 and 245 formed were the fasteners 242 and 244 attach to dart 200 to allow collet 232 to extend longitudinally as collet 232 and finger 234 move radially inward due to collet's 232 and finger's 234 interaction with the seat, such as seat 72 in FIG. 2. A collet 232 is shown attached to dart 200 by screws any attachment means known may be utilized for instance a rivet may be used or in the event that collet 232 is formed from two pieces collet 232 may be welded in place in certain events a collet that does not allow for reverse movement and therefore does not extend to a second attachment point on dart 200 may also be used. As dart 200 reaches a seat such as seat 72 in FIG. 2, seat 72 will begin to interact with collet 232 on the forward portion 238 there by pressing inward on collet 232 enforcing finger 234 to be radially retracted towards the interior of the dart 200.

Figure 4:
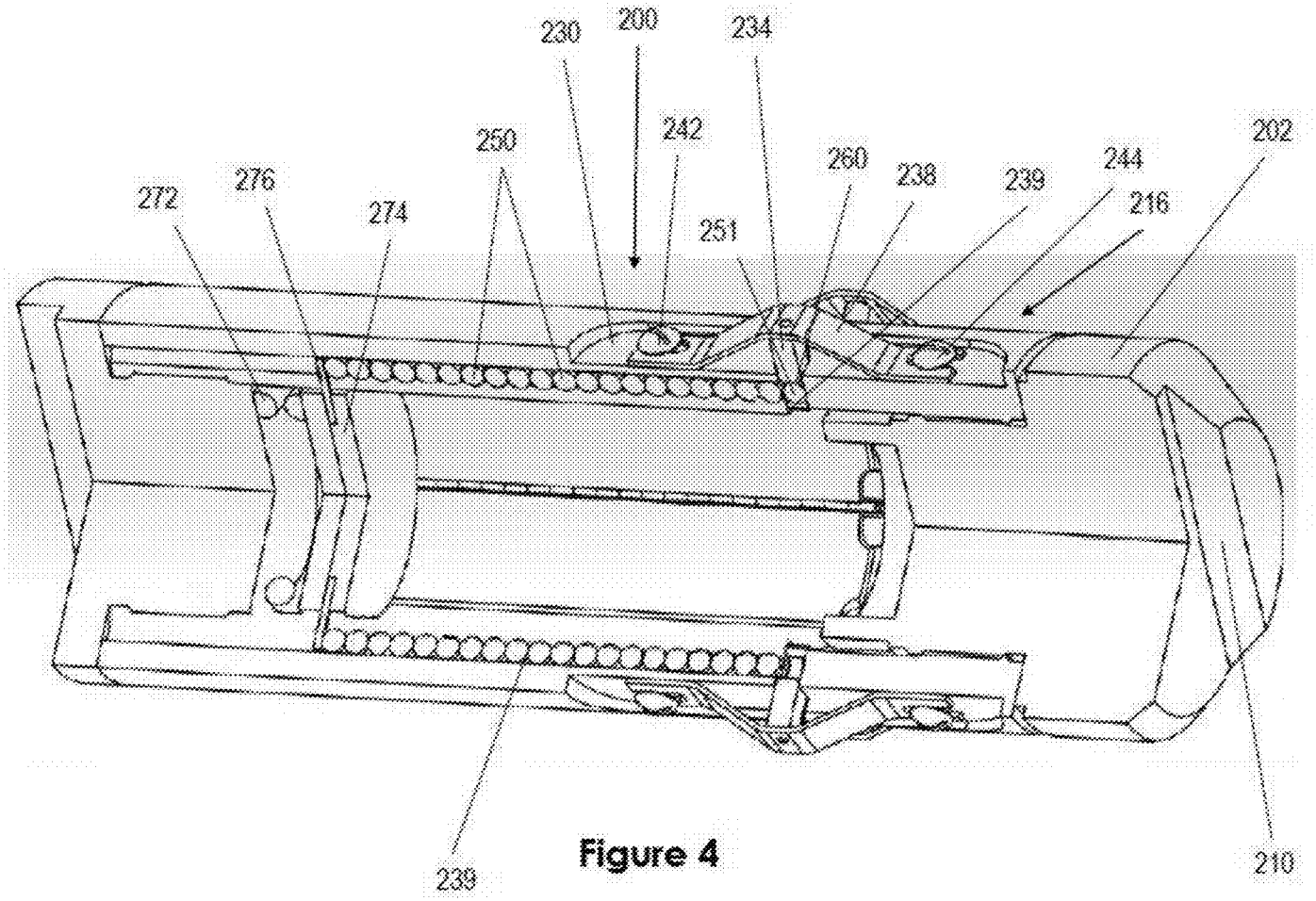
FIG. 4 is a cutaway of the dart in FIG. 3.

FIG. 4 is a cutaway of dart 200 from FIG. 3. Dart 200 is shown as set to actuate 22 downhole tools. Dart 200 has 21 placeholders or balls 250 in track 239 allowing dart 200 to pass through 21 seats while seating on the $22^{nd}$ seat. As shown a particular ball 251 is shown in first position with respect to finger 234. Balls 250 are biased towards the first position 260 by biasing device 272. While biasing device 272 is shown as a spring a compressed gas, expanding elastomer, or any other biasing device may be utilized. Biasing device 272 presses against plate 274. Plate 274 has a pin 276 that in turn acts upon balls 250 to keep moving the balls 250 forward into first position 260 as balls such as 251 are removed from first position.

Figure 5:
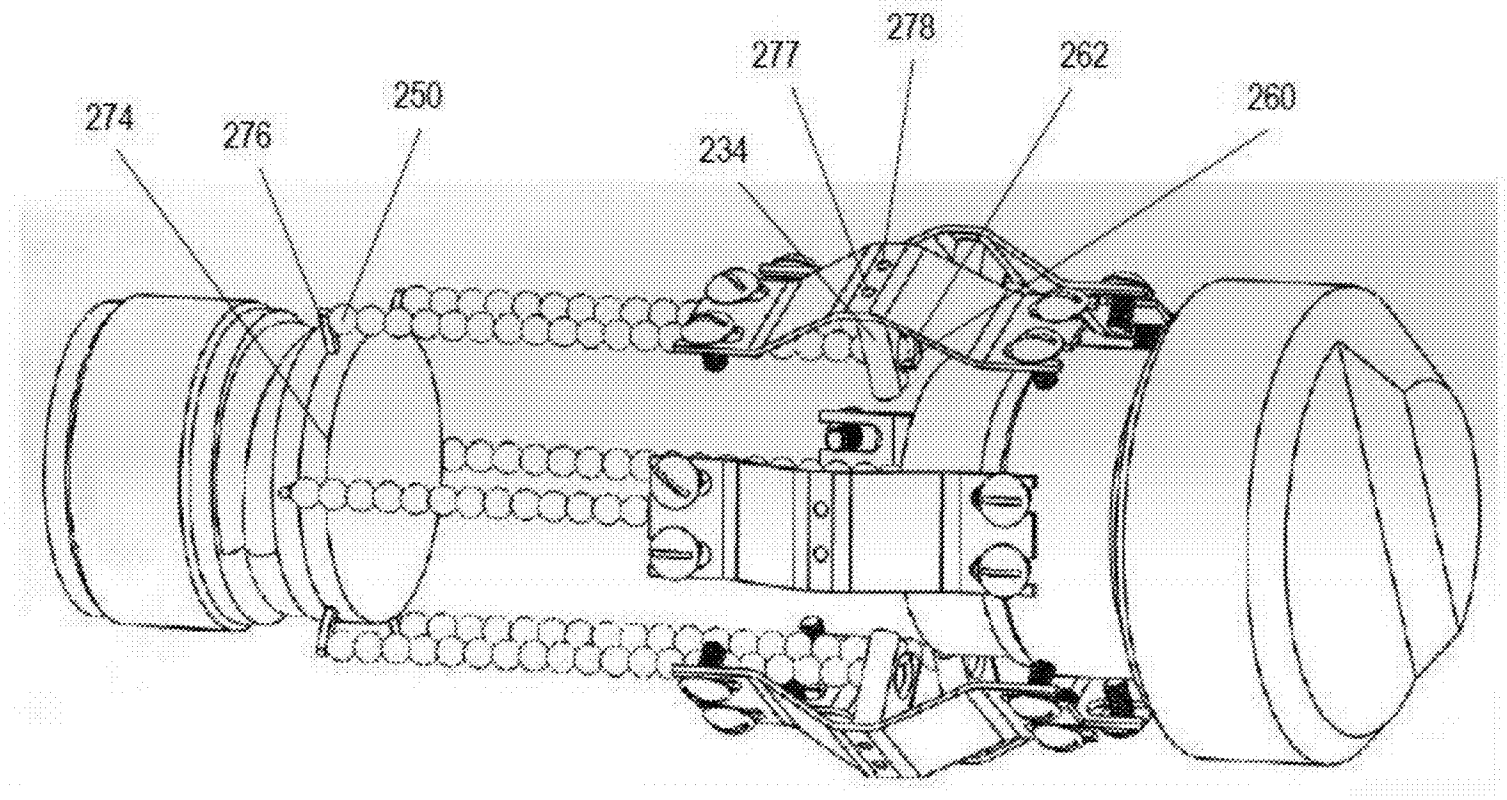
FIG. 5 is a view of a dart with portions redacted for clarity.

FIG. 5 is a redacted view of dart 200 more clearly depicting pin 276 in plate 274 adjacent to a ball 250 enforcing the series of balls 250 forward such that ball 251 is retained in the first position 260 within port 262 formed in finger 234. Also shown in FIGS. 4 and 5 are holes 277 and 278. Holes 277 and 278 are provided to interact with finger 234 to provide additional rigidity to finger 234.

Figure 6:
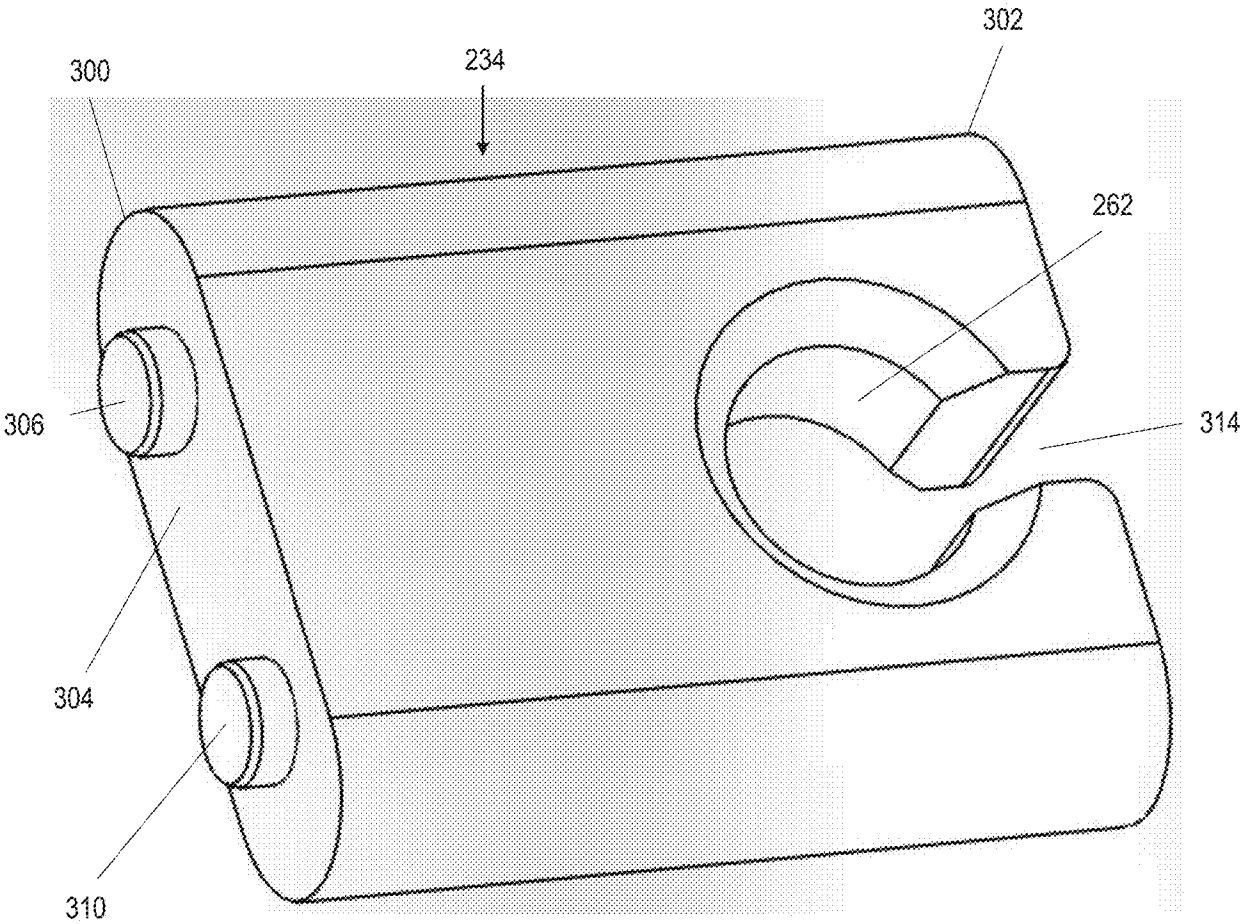
FIG. 6 is a close-up of a finger.

FIG. 6 is a close-up of finger 234. Shown to the left is the upper end 300 of finger 234 and to the right is the lower end 302 of finger 234. On the upper surface 304 of finger 234 is a first protrusion 306 and the second protrusion 310 that reside within holes 277 and 278 as indicated in FIG. 5. Additionally finger 234 is provided with a port 262 at the lower end of port 262 is a slot 314.

Figure 7:
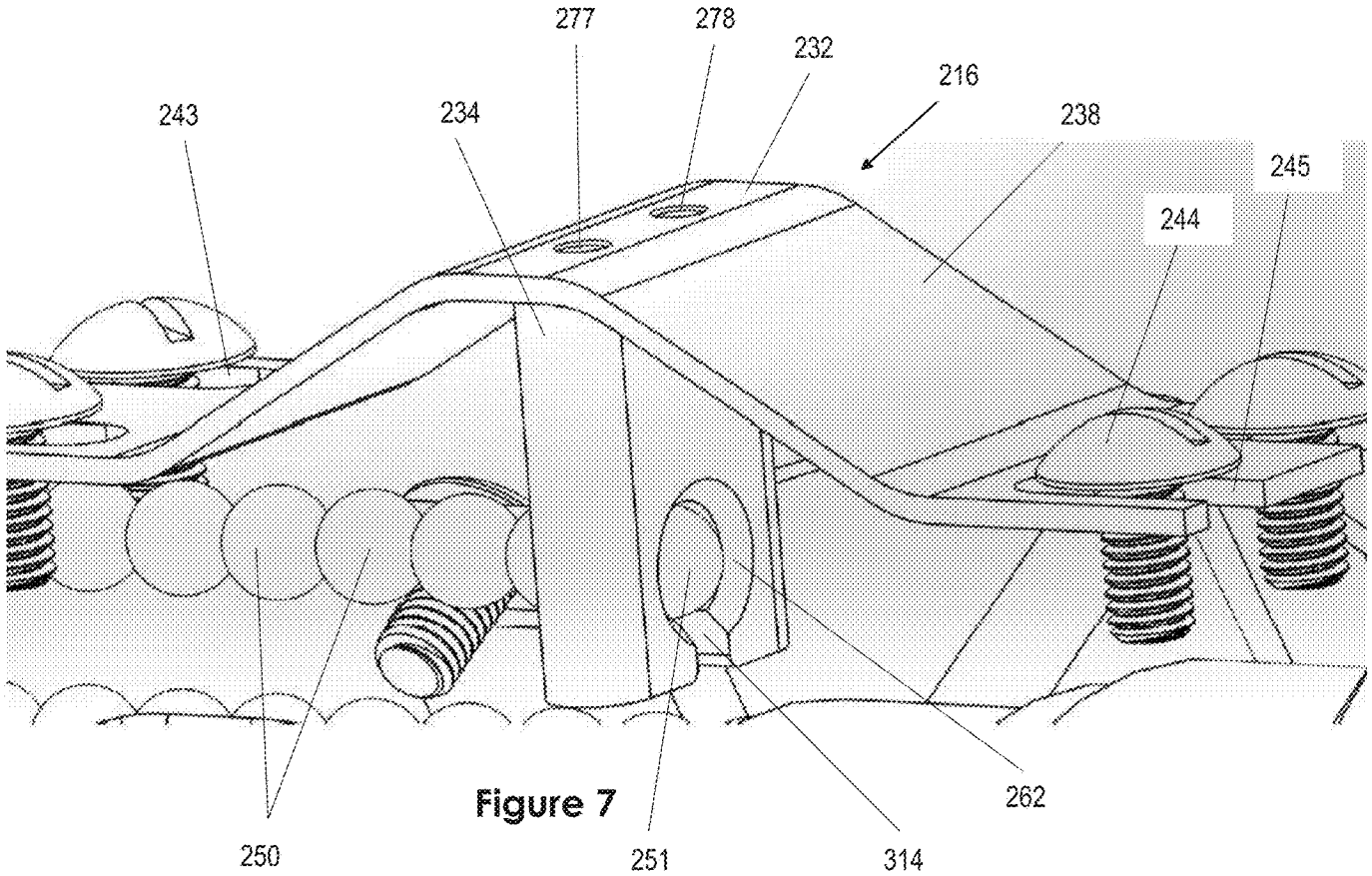
FIG. 7 is a close-up orthogonal view of indexing assembly.

FIG. 7 is a close-up orthogonal view of indexing assembly 216 showing ball 251 import 262. While there is a slot 314 radially inward of port 262 ball 251 is retained within the port 261. Additional balls 250 are stacked behind ball 251 each waiting their turn to be moved into the first position within port 261. Indexing assembly 261 has screws 242 and 244 within slots 243 and 245 to allow collet 232 to expand longitudinally when collet 232 and finger 234 are pressed radially inward by a seat such as seat 74 in FIG. 2.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A mechanically actuated dart system comprising:
- a body configured to be pumped through a wellbore;
- a finger disposed in the body and configured to move between a first position and a second position in response to the body moving past a seat in the wellbore and the finger engaging the seat;
- at least one placeholder configured to be released in response to the finger moving from the first position to the second position; and
- a follower configured to lock the finger into the first position after a last placeholder of the at least one placeholder is released.

2. The mechanically actuated dart system of claim 1 wherein, the placeholder is a ball.

3. The mechanically actuated dart system of claim 1 wherein, the placeholder is a rod.

4. The mechanically actuated dart system of claim 1 wherein, the finger is at least two fingers.

5. The mechanically actuated dart system of claim 1 wherein, the body has an outer diameter,
- wherein the seat has an inner diameter, and
- further wherein the body's outer diameter is approximately the same diameter as the inner diameter of the seat.

6. The mechanically actuated dart system of claim 1 further comprising a seal about the outer diameter of the body.

7. The mechanically actuated dart system of claim 1 further comprising an anti-rotation device.

8. The mechanically actuated dart system of claim 7 wherein, the antirotation device is at least one castellation.

9. The mechanically actuated dart system of claim 7 wherein, the antirotation device is at a leading end of the body.

10. The mechanically actuated dart system of claim 7 wherein, the antirotation device is at a trailing end of the body.

11. A method of utilizing a mechanically actuated dart system comprising:
- inserting a mechanically actuated dart into a well, the mechanically actuated dart including:
  - a body having at least one radially extending finger disposed in the body;
  - a placeholder; and
  - a follower;
- pumping the body through a wellbore;
- moving the body past a seat in the wellbore;
- in response to moving the body past the seat, moving the finger from a radially extended position to a radially retracted position;
- releasing the placeholder in response to the finger moving from the radially extended position to the radially retracted position;
- locking the finger into a radially extended position utilizing the follower to prevent the finger from moving from the radially extended position to the radially retracted position upon release of a predetermined number of placeholders.

12. The method of claim 11 wherein, the placeholder is a ball.

13. The method of claim 11 wherein, the placeholder is a rod.

14. The method of claim 11 wherein, the finger is at least two fingers.

15. The method of claim 11 wherein, the body has an outer diameter, wherein the seat has an inner diameter, and further wherein the body's outer diameter is approximately the same diameter as the inner diameter of the seat.

16. The method of claim 11 further comprising a seal about the outer diameter of the body.

17. The method of claim 11 further comprising an anti-rotation device.

18. The method of claim 17 wherein, the anti-rotation device is at least one casteliation.

19. The method of claim 17 wherein, the anti-rotation device is at a leading end of the body.

20. The method of claim 17 wherein, the anti-rotation device is at a trailing end of the body.

21. A mechanically actuated dart system comprising:

a bod configured to be pumped through a wellbore;

a finger comprising a radially inner end and a radially outer end, wherein the radially inner end of the finger is configured to move between a radially outward position and a radially inward position in response to the body moving past a seat in a wellbore and the finger engaging the seat;

at least one placeholder configured to be released in response to the radially inner end of the finger moving from the radially outward position to the radially inward position; and a follower disposed in the body and configured to lock the finger into the radially outward position after a last placeholder of the at least one placeholder is released.

* * * * *